US011348505B2

(12) United States Patent
Shin et al.

(10) Patent No.: US 11,348,505 B2
(45) Date of Patent: May 31, 2022

(54) DISPLAY DEVICE AND DRIVING METHOD THEREOF

(71) Applicant: SAMSUNG DISPLAY CO., LTD., Yongin-si (KR)

(72) Inventors: Yong Jin Shin, Yongin-si (KR); Kyun Ho Kim, Yongin-si (KR); Hyoung Wook Kim, Yongin-si (KR); Bong Im Park, Yongin-si (KR); Uk Jae Jang, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/196,021

(22) Filed: Mar. 9, 2021

(65) Prior Publication Data

US 2021/0287583 A1 Sep. 16, 2021

(30) Foreign Application Priority Data

Mar. 12, 2020 (KR) ..... 10-2020-0030883

(51) Int. Cl.
*G09G 3/20* (2006.01)

(52) U.S. Cl.
CPC ..... *G09G 3/20* (2013.01); *G09G 2310/08* (2013.01)

(58) Field of Classification Search
CPC ..... G09G 3/20; G09G 2310/08
See application file for complete search history.

(56) References Cited

U.S. PATENT DOCUMENTS

| | | | | |
|---|---|---|---|---|
| 9,424,770 | B2 | 8/2016 | Kim et al. | |
| 2017/0316737 | A1 | 11/2017 | Park | |
| 2018/0190192 | A1 | 7/2018 | Kwon et al. | |
| 2020/0302854 | A1* | 9/2020 | Yuan | G09G 3/3266 |
| 2020/0302873 | A1* | 9/2020 | Yamazaki | H01L 29/786 |
| 2020/0302874 | A1* | 9/2020 | Xu | G09G 3/3266 |
| 2020/0303303 | A1* | 9/2020 | Kim | H01L 28/20 |

FOREIGN PATENT DOCUMENTS

| | | | |
|---|---|---|---|
| KR | 1020170026929 | A | 3/2017 |
| KR | 1020180015321 | A | 2/2018 |
| KR | 102005052 | B1 | 7/2019 |

* cited by examiner

*Primary Examiner* — Sejoon Ahn
(74) *Attorney, Agent, or Firm* — Cantor Colburn LLP

(57) ABSTRACT

A display device includes: a display panel including pixels; a scan driver which supplies a scan signal to scan lines connected to the pixels and supplies a sensing signal to sensing lines connected to the pixels; a data driver which supplies a data signal corresponding to image data to data lines connected to the pixels; a sensing part which senses a threshold voltage of a first transistor included in each of the pixels through receiving lines connected to the pixels, and corrects the sensed threshold voltage based on a voltage drop corresponding to at least one of an internal resistance of the data lines and an internal resistance of the receiving lines; and a timing controller which generates the image data by changing input image data based on the corrected threshold voltage.

20 Claims, 9 Drawing Sheets

DISPLAY DEVICE AND DRIVING METHOD THEREOF

This application claims priority to Korean Patent Application No. 10-2020-0030883, filed on Mar. 12, 2020, and all the benefits accruing therefrom under 35 U.S.C. § 119, the content of which in its entirety is herein incorporated by reference.

BACKGROUND

(a) Field

Embodiments of the invention relate to a display device, and more particularly, to a display device and a driving method thereof.

(b) Description of the Related Art

As information technology has developed, the importance of a display device, which is a connection medium between a user and information, has been highlighted. Accordingly, the use of display devices such as a liquid crystal display device, an organic light emitting display device, and a plasma display device has been increasing.

In a display device, each pixel may emit light with a luminance corresponding to a data voltage supplied thereto through a data line. The display device may display an image frame by a combination of light emitted from the pixels.

Each of the pixels may be connected to a corresponding data line. Accordingly, a scan driver may be used to supply a scan signal for selecting a pixel to which a data voltage is supplied among the pixels. The scan driver may include a shift register to sequentially supply a scan signal of a turn-on level in units of a scan line.

In addition, as necessary, a receiving line may be connected to the plurality of pixels in order to sense a mobility and a threshold voltage characteristic of a driving transistor of the pixel, and a deterioration characteristic of a light emitting element, and the like.

SUMMARY

Embodiment of the invention are directed to a display device that may sense a voltage drop corresponding to wire resistance of a data line and a receiving line, correct a threshold voltage sensed at each pixel, and externally compensate the data signal by the corrected threshold voltage and supply the compensated data signal to each pixel.

Embodiments of the invention are directed to a driving method of the display device.

An embodiment of the invention provides a display device including: a display panel including a plurality of pixels; a scan driver which supplies a scan signal to a plurality of scan lines connected to the pixels and supplies a sensing signal to a plurality of sensing lines connected to the pixels; a data driver which supplies a data signal corresponding to image data to a plurality of data lines connected to the pixels; a sensing part which senses a threshold voltage of a first transistor included in each of the pixels through a plurality of receiving lines connected to the pixels, and corrects the sensed threshold voltage based on a voltage drop corresponding to at least one of an internal resistance of the data lines and an internal resistance of the receiving lines; and a timing controller which generates the image data by changing input image data based on a corrected threshold voltage.

In an embodiment, the sensing part may include a threshold voltage sensing part which senses the threshold voltage of the first transistor; a voltage drop sensing part which senses the voltage drop for at least two selected pixels among target pixels connected to a j-th data line and a j-th receiving line among the pixels, and which calculates the voltage drop for each of the target pixels by using a sensed voltage drop, where j is a positive integer; an offset voltage calculator which calculates an offset voltage compensating for the voltage drop; and an offset voltage adder which adds and outputs the threshold voltage sensed for the target pixels to the offset voltage.

In an embodiment, the at least two selected pixels may include a first pixel disposed on a first horizontal line of the display panel and a second pixel disposed on a last horizontal line of the display panel.

In an embodiment, the sensing part and the data driver may be disposed at a same side of the display panel.

In an embodiment, the scan driver may supply the scan signal and the sensing signal to a scan line and a sensing line which are connected to the first pixel, respectively, and the data driver may supply a reference voltage determined based on the threshold voltage sensed for the first pixel to a data line connected to the first pixel.

In an embodiment, the reference voltage may be a voltage obtained by adding a voltage of a first power source and a threshold voltage sensed for the first transistor of the first pixel.

In an embodiment, the voltage drop sensed for the at least two selected pixels may include a voltage drop corresponding to an internal resistance of a line to which the first power source is applied.

In an embodiment, the voltage drop sensing part may calculate a maximum voltage drop by differentiating a first voltage drop sensed for the first pixel and a second voltage drop sensed for the second pixel.

In an embodiment, the voltage drop sensing part may calculate the voltage drop for each of the target pixels by interpolating the maximum voltage drop based on a number of horizontal lines in which the pixels are disposed.

In an embodiment, each of the target pixels may include the first transistor connected between a first power source and a second node, where the first transistor may include a gate electrode connected to a first node; a second transistor connected between the j-th data line and the first node, where the second transistor may include a gate electrode connected to a corresponding one of the scan lines; a third transistor connected between the second node and a third node connected to the j-th receiving line, where the third transistor may include a gate electrode connected to a corresponding one of the sensing lines; a storage capacitor connected between the first node and the second node; and a light emitting element including a first electrode connected to the second node and a second electrode connected to a second power source.

In an embodiment, the display panel may further include a sensing capacitor connected between a ground and a fourth node connected through the j-th receiving line to the third node. In such an embodiment, the sensing capacitor may store a voltage applied to the fourth node and transmit a stored voltage to the sensing part.

In an embodiment, the voltage drop sensing part may senses the voltage drop for the at least two selected pixels based on a voltage transmitted from the sensing capacitor.

Another embodiment of the invention provides a driving method of a display device, including: sensing a threshold voltage of a first transistor included in each of a plurality of pixels of the display device through a plurality of receiving lines connected to the pixels; calculating a voltage drop corresponding to an internal resistance of a plurality of data lines and the receiving lines connected to the pixels; correcting a sensed threshold voltage based on a calculated voltage drop; and generating image data based on a corrected threshold voltage and supplying a data signal corresponding to the image data to the data lines.

In an embodiment, the calculating the voltage drop may include sensing a voltage drop for at least two selected pixels among target pixels connected to a j-th data line and a j-th receiving line, where j is a positive integer; calculating a voltage drop for each of the target pixels by using the sensed voltage drop; calculating an offset voltage which compensates for a calculated voltage drop; and adding and outputting the offset voltage and the threshold voltage sensed for the target pixels.

In an embodiment, the at least two selected pixels may include a first pixel disposed on a first horizontal line of a display panel and a second pixel disposed on a last horizontal line of the display panel.

In an embodiment, the sensing the voltage drop for the at least two selected pixels may include supplying a scan signal and a sensing signal to a scan line and a sensing line which are connected to the first pixel, respectively, and supplying a reference voltage determined based on a threshold voltage sensed for the first pixel to a data line connected to the first pixel.

In an embodiment, the reference voltage may be a voltage obtained by adding a voltage of a first power source and a threshold voltage sensed for the first transistor of the first pixel.

In an embodiment, the voltage drop for the at least two selected pixels may include a voltage drop corresponding to an internal resistance of a line to which the first power source is applied.

In an embodiment, the calculating the voltage drop for each of the target pixels may include calculating a maximum voltage drop by differentiating a first voltage drop sensed for a first pixel and a second voltage drop sensed for the second pixel from each other.

In an embodiment, the calculating the voltage drop for each of the target pixels may include calculating a voltage drop for each of the target pixels by interpolating the maximum voltage drop based on a number of horizontal lines in which the pixels are disposed.

According to embodiments of the display device and the driving method thereof according to the invention, a voltage drop corresponding to wire resistance of a data line and a receiving line is effectively sensed to correct a threshold voltage sensed at each pixel.

In such embodiments, a threshold voltage error due to the wire resistance of the data line and the receiving line may be reduced, such that performance of externally compensating a threshold voltage for a driving transistor of each pixel may be further improved.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
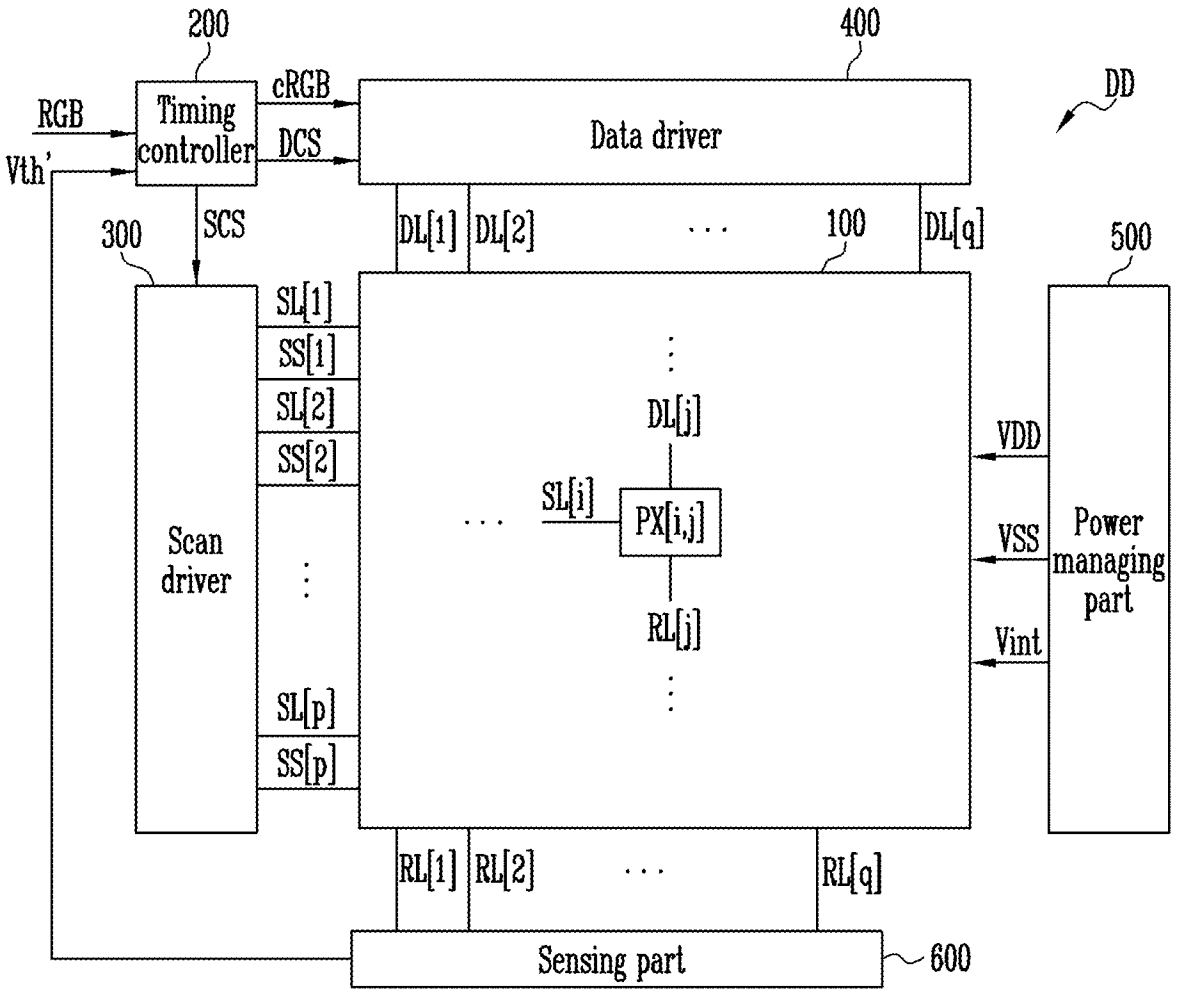
FIG. 1 is a block diagram showing a display device according to an embodiment of the invention.

The invention will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the invention will be described in detail with reference to the accompanying drawings.

FIG. 1 is a block diagram showing a display device according to an embodiment of the invention.

Referring to FIG. 1, an embodiment of a display device DD may include a display panel 100, a timing controller 200, a scan driver 300, a data driver 400, a power managing part 500 (or a power managing driver), and a sensing part (or a sensing driver) 600.

The display panel 100 may include a plurality of pixels PX[i,j]. The plurality of pixels PX[i,j] may include p rows (p is a natural number) and q columns (q is a natural number). Pixels PX[i,j] disposed in a same row (hereinafter, may be alternatively referred to as a horizontal line) may be connected to a same scan line and a same sensing line. Pixels PX[i,j] disposed in a same column (hereinafter, may be alternatively referred to as a vertical line) may be connected to a same data line and a same receiving line. In one embodiment, for example, the pixels PX[i,j] disposed in an i-th row (i is a natural number less than or equal to p) and a j-th column (j is a natural number less than or equal to q) may be connected to an i-th scan line SL[i] and an i-th sensing line SS[i], and may be connected to a j-th data line DL[j] and a j-th receiving line RL[j].

In the display panel 100, an area in which pixels PX[i,j] are disposed is a display area, and a non-display area in which the pixels PX[i,j] are not disposed may be defined on at least one side portion of the display area. At least one element selected from the timing controller 200, the scan driver 300, the data driver 400, the sensing part 600, and the power managing part 500 may be disposed in the non-display area.

The timing controller 200 may generate a scan driving control signal SCS and a data driving control signal DCS in response to synchronization signals supplied from an outside. The scan driving control signal SCS may be supplied to the scan driver 300, and the data driving control signal DCS may be supplied to the data driver 400. In such an embodiment, the timing controller 200 may supply an image data cRGB rearranged based on an input image data RGB supplied from the outside to the data driver 400.

The scan driving control signal SCS may include a start signal and clock signals. The start signal may be a signal for controlling a start timing of the scan signal.

The data driving control signal DCS may include a source start pulse and clock signals. The source start pulse may control a start point of sampling of data. The clock signals may be used to control a sampling operation.

The scan driver 300 may receive the scan drive control signal SCS from the timing controller 200, and sequentially supply scan signals to scan lines (SL[1], SL[2], . . . , SL[p]) based on the scan driving control signal SCS. When the scan signals are sequentially supplied, the pixels PX[i,j] may be selected in units of a horizontal lines (or pixel row units), and data signals may be supplied to the selected pixels PX[i,j].

In an embodiment, the scan driver 300 may sequentially supply the sensing signals to the sensing lines (SS[1], SS[2], . . . , SS[p]) based on the scan driving control signal SCS. When the sensing signals are sequentially supplied, the pixels PX[i,j] may be selected in horizontal line units (or pixel row units), and characteristic information on the selected pixels PX[i,j] (for example, a threshold voltage of the driving transistor of the pixel PX[i,j], a mobility of the driving transistor, deterioration of the light emitting element, etc.) may be sensed or detected by the sensing part 600.

The data driver 400 may receive the data driving control signal DCS and image data cRGB from the timing controller 200. The data driver 400 may supply data signals to the data lines (DL[1], DL[2], . . . , DL[q]) in response to the data driving control signal DCS. The data signals supplied to the data lines (DL[1], DL[2], . . . , DL[q]) may be supplied to the pixels PX[i,j] arranged on the horizontal line selected by the scan signal. In such an embodiment, the data driver 400 may supply the data signals to the data lines (DL[1], DL[2], . . . , DL[q]) to be synchronized with the scan signal.

The power managing part 500 may supply a voltage of a first power source VDD and a voltage of a second power source VSS to the display panel 100. In an embodiment, the power managing part 500 may supply an initialization voltage according to an initialization power source Vint. Although not illustrated, initialization lines for supplying the initialization voltage based on the initialization power source Vint may be connected to each pixel PX[i,j] of the display panel 100.

The first power source VDD and the second power source VSS may generate voltages for driving the light emitting element included in each pixel PX[i,j] of the display panel 100. In an embodiment, the voltage of the second power source VSS may be lower than the voltage of the first power source VDD. In one embodiment, for example, the voltage of the first power source VDD may be a positive voltage, and the voltage of the second power source VSS may be a negative voltage.

The initialization power source Vint may be a power source that initializes each pixel PX[i,j] included in the display panel 100. In one embodiment, for example, the driving transistor and/or the light emitting element included in the pixel PX[i,j] may be initialized by the voltage of the initialization power source Vint.

The sensing part 600 may sense or detect a threshold voltage Vth (or a change in the threshold voltage Vth) of the driving transistor included in each pixel PX[i,j] based on a current or voltage obtained from the receiving lines (RL[1], RL[2], RL[3], . . . , RL[q]).

In an embodiment, the sensing part 600 may sense a voltage drop caused by internal resistance of the receiving lines (RL[1], RL[2], RL[3], . . . , RL[q]) and/or the data lines (DL[1], DL[2], . . . , DL[q]), and may correct the previously sensed threshold voltage Vth based on the sensed voltage drop. The sensing part 600 may transmit a threshold voltage (Vth') corrected by using the voltage drop to the timing controller 200. Accordingly, in an embodiment of the invention, the primarily sensed threshold voltage Vth is corrected in consideration of the voltage drop of the receiving lines (RL[1], RL[2], RL[3], . . . , RL[q]) and/or the data lines (DL[1], DL[2], . . . , DL[q]), such that the threshold voltage (Vth') of each pixel PX[i,j] may be more accurately sensed.

In an embodiment, the sensing part 600 may further sense a deterioration characteristic such as the mobility of the driving transistor included in each pixel PX[i,j] and/or a deterioration characteristic (a change in the threshold voltage) of the light emitting element included in each pixel PX[i,j], based on the current or voltage obtained from the receiving lines (RL[1], RL[2], RL[3], . . . , RL[q]).

The timing controller 200 may receive the image data RGB from the outside, convert the image data RGB based on the threshold voltage (Vth') received from the sensing part 600, and transmit the converted image data cRGB to the data driver 400. In an embodiment, the timing controller 200 may convert the image data RGB based on the threshold voltage Vth' that corrects the voltage drop occurring in the receiving lines (RL[1], RL[2], RL[3], . . . , RL[q]). Accordingly, the timing controller 200 may reflect the threshold voltage Vth' for each pixel PX[i,j] to the converted image data cRGB.

The data driver 400, based on the image data cRGB received from the timing controller 200, may supply the data signal that compensates the threshold voltage (Vth') (or, that is changed based on the threshold voltage (Vth')) to the data lines (DL[1], DL[2], . . . , DL[q]).

FIG. 1 illustrates an embodiment where the data driver 400 is at an upper side of the display panel 100 and the sensing part 600 is at a lower side of the display panel 100, but the invention is not limited thereto. In one embodiment, for example, the data driver 400 and the sensing part 600 may be disposed together on an upper portion of the display panel 100. Alternatively, the data driver 400 and the sensing part 600 may be disposed together on a lower portion of the display panel 100.

Hereinafter, for convenience of description, the pixel PX[i,j] disposed in the i-th row and the j-th column may be referred to as a pixel PX[i,j], and the scan line SL[i] corresponding to the i-th row may be interchangeably referred to as a scan line SL[i], the sensing line SS[i] corresponding to the i-th row may be interchangeably referred to as a sensing line SS[i], the data line DL[j] corresponding to the j-th column may be interchangeably referred to as a data line DL[j], and the receiving line RL[j] corresponding to the j-th column may be interchangeably referred to as a receiving line RL[j].

Figure 2:
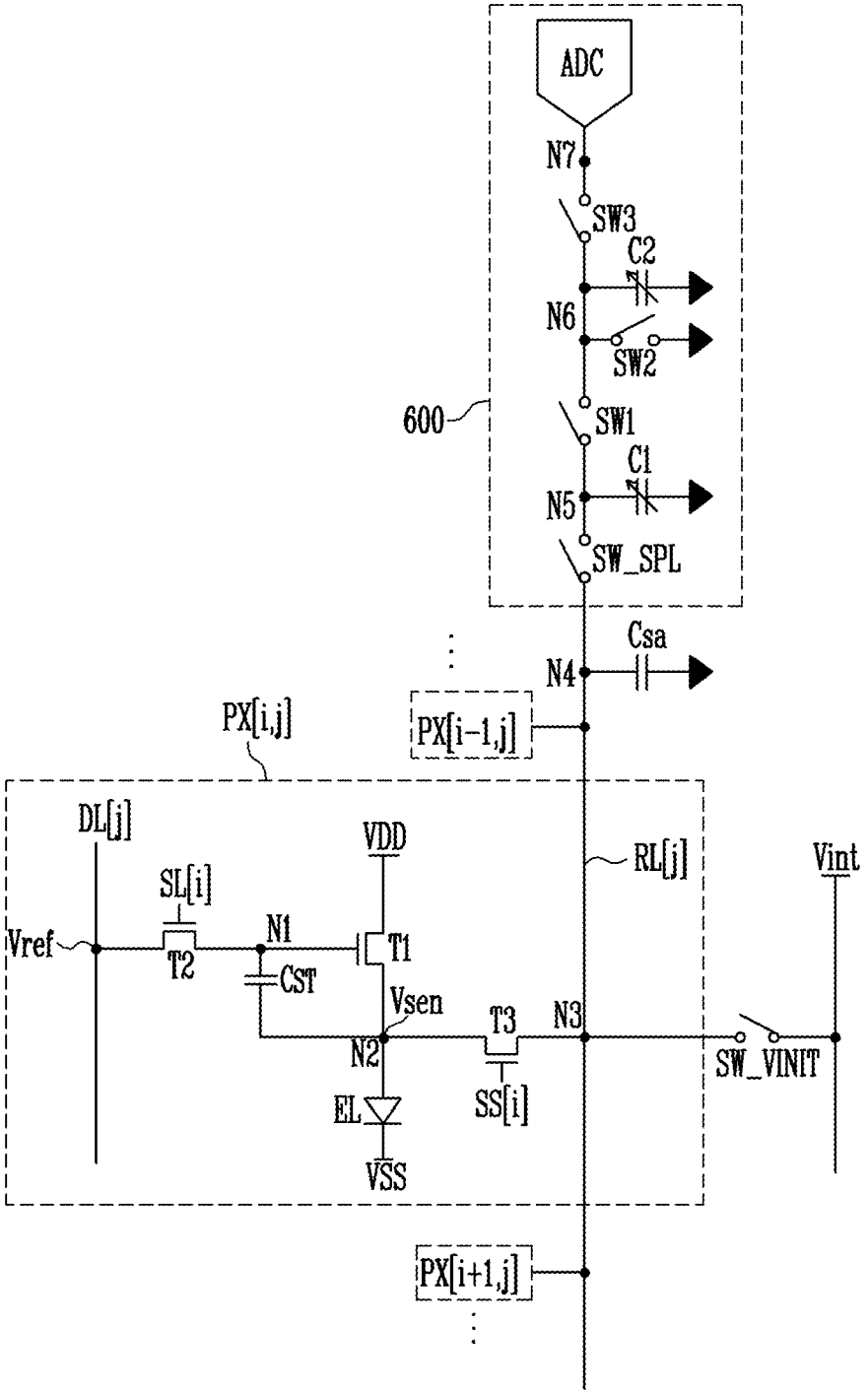
FIG. 2 is a circuit diagram showing a pixel and a sensing part according to an embodiment of the invention.

FIG. 2 is a circuit diagram showing a pixel and a sensing part according to an embodiment of the invention.

Referring to FIG. 2, the pixel PX[i,j] may include a first transistor T1, a second transistor T2, a third transistor T3, a storage capacitor Cst, and a light emitting element EL.

The first transistor T1 may be connected between the first power source VDD and a second N2 corresponding to a first electrode of the light emitting element EL, and may include a gate electrode connected to a first node N1. The first transistor T1 may also be referred to as a driving transistor.

The second transistor T2 may be connected between the data line DL[j] and the first node N1, and may include a gate electrode connected to the scan line SL[i]. When the scan signal is supplied through the scan line SL[i], the second transistor T2 may be turned on, and a reference voltage Vref supplied through the data line DL[j] may be transmitted to the first node N1. Here, the reference voltage Vref may be a data signal supplied to the data line DL[j] during a period of sensing a threshold voltage of the driving transistor T1 (for example, a non-display period), and in a period (for example, a display period) other than the period in which the threshold voltage of the driving transistor T1 is sensed, the data signal generated by the data driver 400 based on the image data cRGB may be supplied to the data line DL[j].

The third transistor T3 may be connected between the second node N2 and a third node N3, and may include a gate electrode connected to the sensing line SS[i]. When the sensing signal is supplied through the sensing line SS[i], the third transistor T3 may be turned on, and the second node N2 and the third node N3 may be electrically connected to each other. In addition, the third node N3 may be connected to the receiving line RL[j]. Accordingly, since a voltage Vsen at the second node N2 is transmitted to the sensing part 600 through the receiving line RL[j], the sensing part 600 may sense the voltage Vsen applied to the second node N2 (or the voltage applied to the first electrode of the light emitting element EL). The third transistor T3 may also be referred to as a sensing transistor.

The storage capacitor Cst may be connected between the first node N1 and the second node N2. The storage capacitor Cst may be charged with a difference voltage between the voltage of the first node N1 and the voltage of the second node N2. In one embodiment, for example, a voltage charged in the storage capacitor Cst may include the threshold voltage Vth of the driving transistor T1.

The light emitting element EL may include a first electrode (or anode electrode) connected to the second node N2 and a second electrode (or cathode electrode) connected to the second power source VSS. The light emitting element EL may emit light at a luminance corresponding to an amount of driving current supplied from the first transistor T1.

In an embodiment, a sensing capacitor Csa may be connected between the reference power source (for example, the ground) and a fourth node N4 connected through the receiving line RL[j] to the third node N3. When the third transistor T3 is turned on, the sensing capacitor Csa may receive and store a voltage transmitted from the second node N2 to the third node N3 through the receiving line RL[j], and may transmit the stored voltage to the sensing part 600. The sensing capacitor Csa may be included in the display panel 100. In one embodiment, for example, the sensing capacitor Csa may be disposed in the non-display area of the display panel 100. In one embodiment, for example, the sensing capacitor Csa may be disposed in an area between the display area of the display panel 100 and the sensing part 600.

In an embodiment, a least one sensing capacitor Csa may be disposed in each receiving line RL[j].

In an embodiment, the first transistor T1, the second transistor T2, and the third transistor T3 may be n-type transistors, but not being limited thereto. Alternatively, at least one selected from the first transistor T1, the second transistor T2, and the third transistor T3 may be a p-type transistor.

In an embodiment, the third node N3 may be connected to a line to which the initialization power source Vint is applied. In such an embodiment, an initialization switch SW_VINT may be connected between the third node N3 and a line to which the initialization power source Vint is applied. Accordingly, when the initialization switch SW_VINT is turned on, the initialization voltage corresponding to the initialization power source Vint may be supplied to the third node N3, and when the third transistor T3 is also turned on, as the initialization voltage is supplied to the second node N2, the voltage of the second node N2 may be initialized to the initialization voltage. The initialization power source Vint may be generated as an output of the power managing part 500 in FIG. 1.

The sensing part 600 may include at least one capacitor C1 or C2 by receiving the voltage stored in the sensing capacitor Csa according to a capacitance ratio thereof, and an analog-to-digital converter ADC that receives the voltage stored in the at least one capacitor C1 or C2, converts the received voltage into a digital signal, and outputs the digital signal.

In one embodiment, for example, the sensing part 600 includes a sensing switch SW_SPL connected between the fourth node N4 and a fifth node N5, the at least one capacitor C1 or C2, at least one switch SW1, SW2, or SW3, and the analog-digital converter ADC.

The at least one capacitor C1 or C2 may include at least one selected from a first capacitor C1 connected between the fifth node N5 and the ground, and a second capacitor C2 connected between a sixth node N6 and the ground.

The at least one switch SW1, SW2, or SW3 may include at least one selected from a first switch SW1 connected between the fifth node N5 and the sixth node N6, a third switch SW3 connected between the sixth node N6 and a seventh node N7, and a second switch SW2 connected between the sixth N6 and the ground.

When the sensing switch SW_SPL is turned on, a voltage charged in the sensing capacitor Csa may be transmitted to the first capacitor C1 based on a ratio between a capacitance of the sensing capacitor Csa and a capacitance of the first capacitor C1.

When the first switch SW1 is turned on, a voltage charged in the first capacitor C1 may be transmitted to the second capacitor C2 based on a capacitance ratio between the first capacitor C1 and the second capacitor C2. When the second switch SW2 is turned on, the second capacitor C2 may be discharged to be reset.

When the second switch SW2 is turned off and the third switch SW3 is turned on, a voltage stored in the second capacitor C2 may be transmitted to a seventh node N7. The analog-to-digital converter ADC may convert a voltage applied to the seventh node N7 into a digital signal to output the converted voltage as a digital signal.

Figure 3:
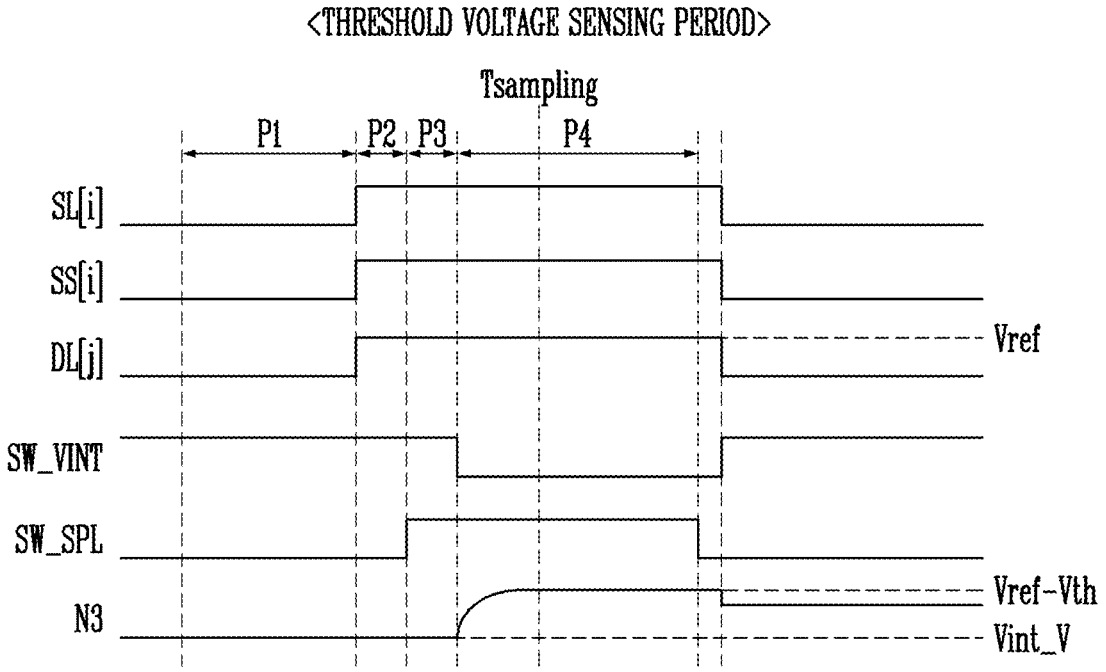
FIG. 3 illustrates an operational waveform diagram during a period in which the sensing part in FIG. 2 senses a threshold voltage of a driving transistor included in a pixel.

FIG. 3 illustrates an operational waveform diagram during a period in which the sensing part in FIG. 2 senses a threshold voltage of a driving transistor included in a pixel.

In an embodiment, in a first period P1, the initialization switch SW_VINT may be in a turn-on state. Accordingly, an initialization voltage Vint_V corresponding to the initialization power source Vint may be applied to the third node N3, and the sensing capacitor Csa connected to the third node N3 through the receiving line RL[j] may be initialized to the initialization voltage Vint_V.

In a second period P2, the second transistor T2 is turned on as the scan signal (which may be a high-level voltage) is supplied through the scan line SL[i]. When the second transistor T2 is turned on, the reference voltage Vref is supplied to the gate electrode of the first transistor T1 through the data line DL[j] as the second transistor T2 is turned on. In the second period P2, as the sensing signal is supplied through the sensing line SS[i], the third transistor T3 is turned on, and the initialization voltage Vint_V applied to the third node N3 may be transmitted to the second node N2.

That is, in the second period P2, the reference signal Vref is applied to the gate electrode of the first transistor T1 (or the first node N1), and the initialization voltage Vint_V is applied to the second electrode of the first transistor T1 (or the second node N2).

In a third period P3, as the sensing switch SW_SPL is turned on, the initialization voltage Vint_V corresponding to the initialization power Vint may be supplied to the sensing part 600. Accordingly, at least one capacitor (for example, the first capacitor C1) included in the sensing part 600 may be initialized to the initialization voltage Vint_V.

In a fourth period P4, as the first switch SW_VINT is turned off and the turn-on state of the second transistor T2 is maintained, the voltage Vsen of the second node N2 (or the second electrode of the first transistor T1) may be increased to a difference voltage (Vref−Vth) between the reference voltage Vref and the threshold voltage Vth of the first transistor T1. The reference voltage Vref for sensing the threshold voltage Vth may be smaller than the voltage of the first power source VDD. Accordingly, when the voltage of the second node N2 is increased to the differential voltage (Vref−Vth), the first transistor T1 is turned off, so that the voltage of the second node N2 is not further increased. In this case, the differential voltage (Vref−Vth) applied to the second node N2 may be transmitted to the third node N3 through the third transistor T3, and the differential voltage (Vref−Vth) transmitted to the third node N3 may be transmitted to the sensing capacitor Csa through the receiving line RL[j]. That is, the sensing capacitor Csa may be charged with the differential voltage (Vref−Vth). The differential voltage (Vref−Vth) charged in the sensing capacitor Csa may be transmitted to the sensing part 600 through the sensing switch SW_SPL of a turn-on state, and the sensing part 600 may obtain the threshold voltage Vth from the differential voltage (Vref−Vth). That is, a time point Tsampling for sensing the threshold voltage may be included in the fourth period P4.

In one embodiment, for example, the sensing part 600 may sense the threshold voltage Vth of the first transistor T1 or a change in the threshold voltage Vth by receiving the differential voltage (Vref−Vth) charged in the sensing capacitor Csa and removing a portion corresponding to the reference voltage Vref from the received differential voltage (Vref−Vth), based on the capacitance ratio between the sensing capacitor Csa and at least one capacitor C1 or C2 included in the sensing part 600.

Figure 4:
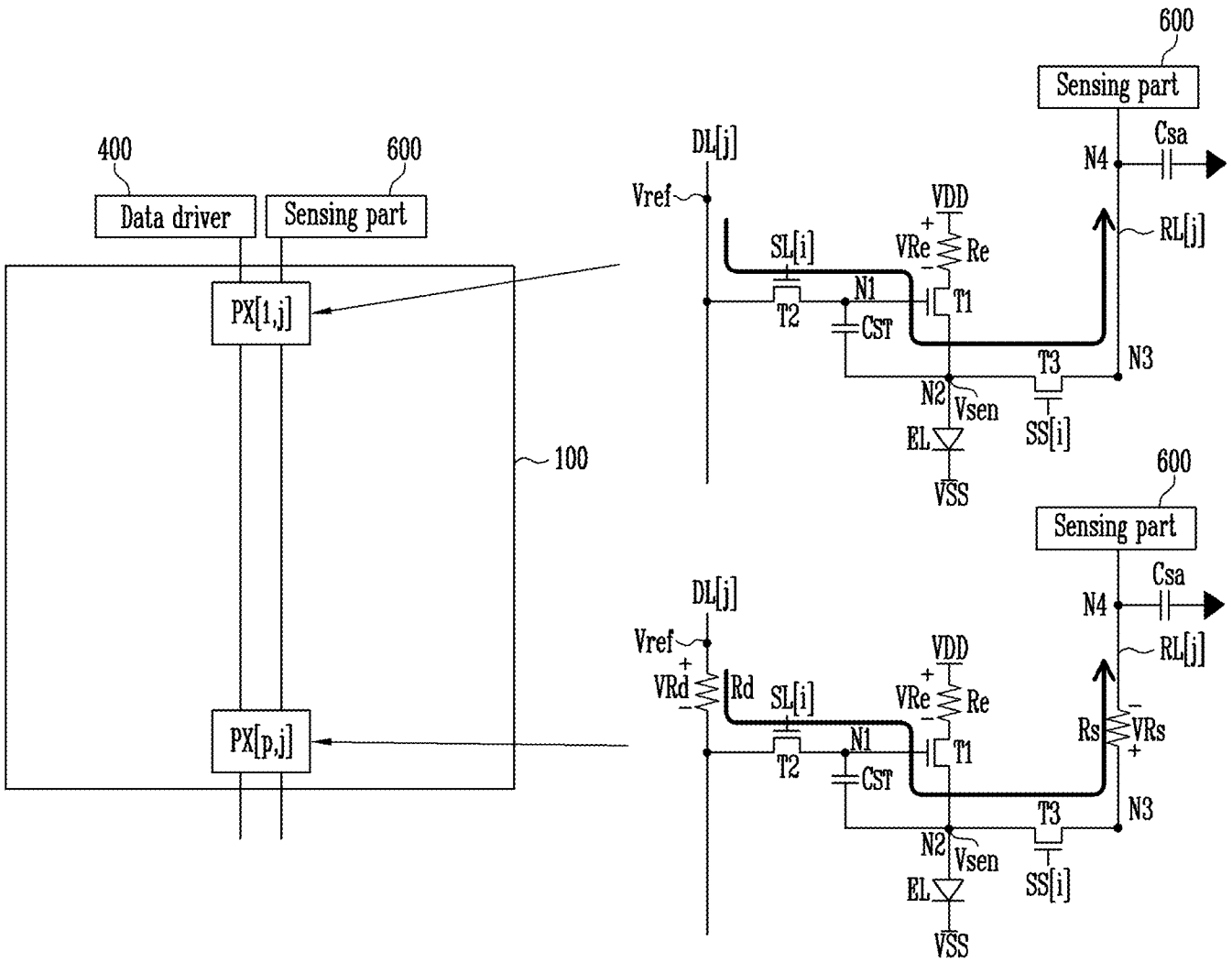
FIG. 4 illustrates a conceptual diagram of internal resistance of a wire in the structure of the pixel and the sensing part in FIG. 2.
Figure 5:
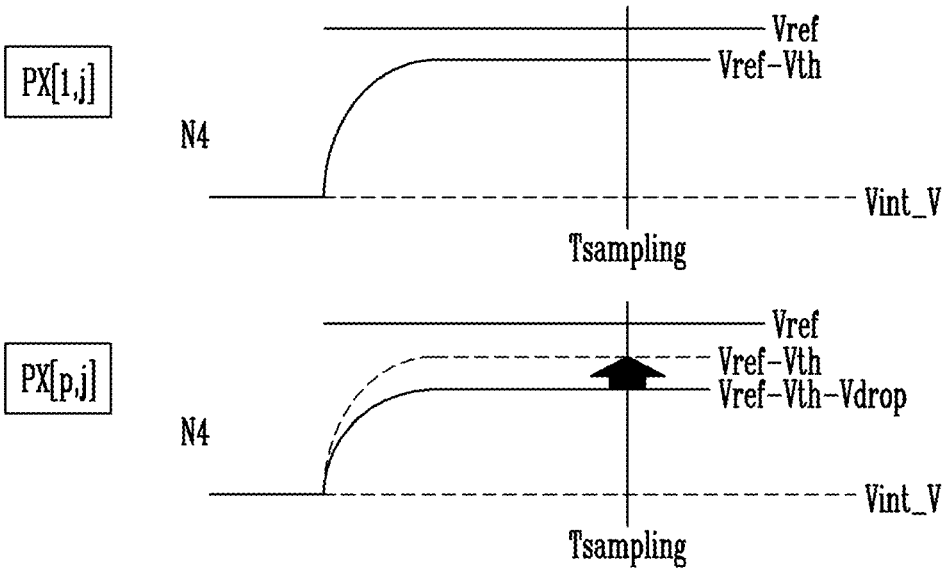
FIG. 5 illustrates a waveform diagram comparing node voltages of pixels in the first pixel row and pixels in the last pixel row in FIG. 4.

FIG. 4 illustrates a conceptual diagram of internal resistance of a wire in the structure of the pixel and the sensing part in FIG. 2. FIG. 5 illustrates a waveform diagram comparing node voltages of pixels in the first pixel row and pixels in the last pixel row in FIG. 4.

FIG. 4 illustrates internal resistance of a wire that affects the threshold voltage Vth when the threshold voltage Vth in the pixel (PX[1,j]) disposed in the first pixel row and the pixel (PX[p,j]) disposed in the last p-th pixel row among the pixels disposed in the j-th column is sensed.

Referring to FIG. 4, the third node N3 and the fourth node N4 are connected to each other through the receiving line RL[j]. Accordingly, the differential voltage (Vref−Vth) applied to the third node N3 is transmitted to the fourth node N4 at the time point (Tsampling) at which the threshold voltage Vth is sensed. However, a voltage of the third node N3 is reduced by a voltage drop corresponding to an internal resistance Rs of the receiving line RL[j] connecting the third node N3 and the fourth node N4 to be transmitted to the fourth node N4.

In such an embodiment, the reference voltage Vref supplied through the data line DL[j] may be reduced by the voltage drop VRd corresponding to an internal resistance Rd of the data line DL[j] to be transmitted to the first electrode of the second transistor T2.

In such an embodiment, a voltage corresponding to the first power source VDD may also be reduced by a voltage drop VRe corresponding to an internal resistance Re of a line to which the first power source VDD is applied to be transmitted to the first electrode of the first transistor T1.

As such, the larger the internal resistances Rs, Rd, Re of the receiving line RL[j], the data line DL[j], and the line to which the first power source VDD are applied, the greater the voltage drop in each line, thus the threshold voltage Vth of the first transistor T1 sensed by the sensing part 600 varies by the voltage drop. In such an embodiment, since a relative length of the wire from the data driver 400 or the sensing part 600 varies depending on a position at which the pixel PX[i,j] is disposed in the display panel 100, a variation amount of the threshold voltage Vth corresponding to the voltage drop may also vary per position of the pixel PX[i,j].

In one embodiment, for example, as illustrated in FIG. 4, when the data driver 400 and/or the sensing part 600 are disposed at one side of the upper portion of the display panel 100, since the data driver 400 and the pixel PX[1,j] disposed in the first pixel row are adjacent to each other, a length of the data line DL[j] connected therebetween is short. In such an embodiment, since the sensing part 600 and the pixel PX[1,j] disposed in the first pixel row are adjacent to each other, a length of the receiving line RL[j] connected therebetween is also short. Accordingly, when the threshold voltage Vth of the pixel PX[1,j] disposed in the first pixel row is sensed, since the internal resistance Rd of the data line DL[j] and/or the internal resistance Rs of the receiving line RL[j] are negligibly small, the voltage drop corresponding to the internal resistances Rd and Rs of the wires may be minimal in the threshold voltage Vth sensed in the pixel PX[1,j] disposed in the first pixel row.

In such an embodiment, since the data driver 400 is the farthest from the pixel PX[p,j] disposed in the last p-th pixel row, a length of the data line DL[j] connected therebetween is also the longest. In such an embodiment, since the sensing part 600 is also the farthest from the pixel PX[p,j] disposed in the last p-th pixel row, a length of the receiving line RL[j] connected therebetween is also the longest. Therefore, when the threshold voltage Vth for the pixel PX[p,j] disposed in the last p-th pixel row is sensed, the internal resistance Rd of the data line DL[j] and/or the internal resistance Rs of the receiving line RL[j] may be considerably large. Accordingly, the threshold voltage Vth sensed in the pixel PX[p,j] disposed in the last p-th pixel row includes a voltage drop corresponding to the wire internal resistances Rd and Rs, which may be significant.

In an embodiment, as described above, in the pixel PX[1,j] disposed in the first pixel row disposed closest to the data driver 400 and the sensing part 600, the internal resistance Rd of the data line DL[j] and/or the internal resistance Rs of the receiving line RL[j] may be minimal. Therefore, referring to FIG. 4 and FIG. 5, at the time point (Tsampling) of sensing the threshold voltage, the voltage applied to the third node N3 of the pixel PX[1,j] disposed in the first pixel row is the difference voltage (Vref−Vth) between the reference voltage Vref and the threshold voltage Vth, and after the difference voltage (Vref−Vth) is stored in the sensing capacitor Csa, the voltage stored in the sensing capacitor Csa may be transmitted to the fourth node N4 as it is.

In such an embodiment, a voltage drop VRd corresponding to the internal resistance Rd of the data line DL[j] exists in the pixel PX[p,j] disposed in the last p-th pixel row. Therefore, referring to FIG. 4 and FIG. 5, at the time point (Tsampling) of sensing the threshold voltage Vth, a voltage (Vref−VRd) reduced by the voltage drop VRd of the data line DL[j] from the reference voltage Vref is applied to the gate electrode of the first transistor T1. In such an embodiment, a voltage (Vref−Vth−VRd) obtained by subtracting or by differentiating the voltage drop VRd of the data line DL[j] and the threshold voltage Vth from the reference voltage Vref is applied to the second node N2. Further, the voltage (Vref−Vth−VRd) of the second node N2 may be transmitted to the third node N3, and a voltage (Vref−Vth−VRd−VRs) reduced by a voltage drop VRs corresponding to the internal resistance Rs of the receiving line RL[j] from the voltage (Vref−Vth−VRd) transmitted to the third node N3 may be transmitted to the sensing capacitor Csa. Accordingly, the voltage transmitted to the sensing capacitor Csa may be a voltage (Vref−Vth−Vdrop) obtained by subtracting the threshold voltage Vth and a voltage drop (Vdrop=VRd+VRs) of the data line DL[j] and the receiving line RL[j] from the reference voltage Vref.

As a result, since the threshold voltage Vth sensed by the sensing part 600 may be varied by the voltage drop (Vdrop=VRd+VRs) of the data line DL[j] and the receiving line RL[j], it is desired to correct the voltage drop Vdrop.

Accordingly, an embodiment of the invention provides a method that may more accurately sense the threshold voltage Vth by sensing the threshold voltage Vth in each pixel and by correcting (or changing) the sensed threshold voltage Vth based on the voltage drop (Vdrop=VRd+VRs) of the data line DL[j] and the receiving line RL[j].

Figure 6:
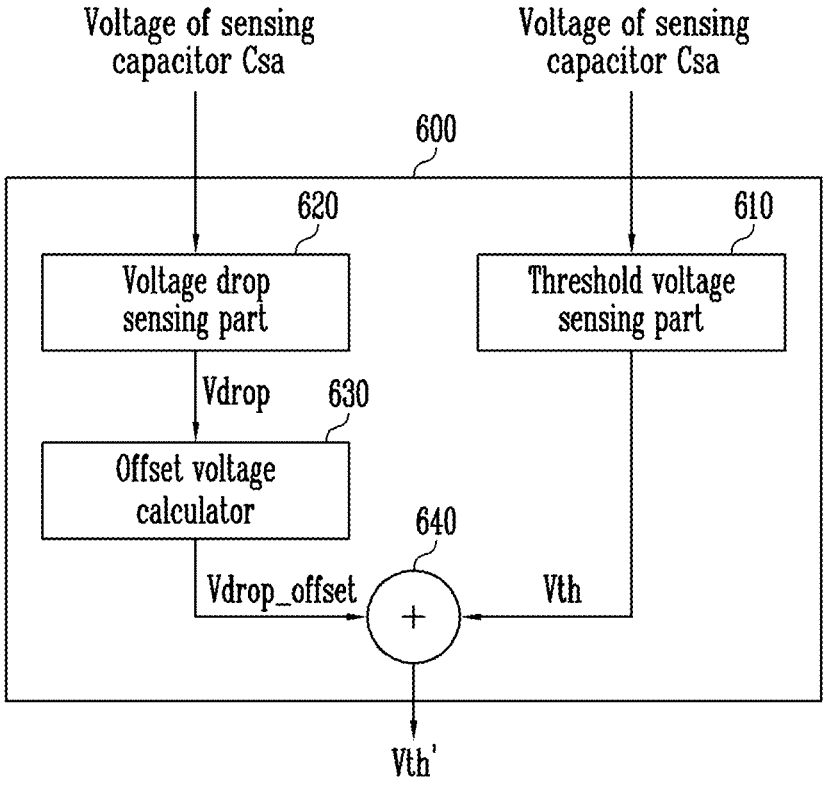
FIG. 6 illustrates a block diagram of a sensing part according to an embodiment of the invention.

FIG. 6 is a block diagram showing a sensing part according to an embodiment of the invention.

Referring to FIG. 6, an embodiment of the sensing part 600 according to the invention may include a threshold voltage sensing part (or a threshold voltage sensing circuit) 610, a voltage drop sensing part (or a voltage drop sensing circuit) 620, an offset voltage calculator (or an offset voltage calculating circuit) 630, and an offset voltage adder (or an offset voltage adding circuit) 640.

The threshold voltage sensing part 610 may sense the threshold voltage of the driving transistor T1 included in the pixel. In an embodiment, the data driver 400 and the scan driver 300 perform an operation corresponding to the threshold voltage sensing period described above with reference to FIG. 3, so that the differential voltage (Vref−Vth) may be stored in the sensing capacitor Csa in the circuit configuration as shown in FIG. 2, and the threshold voltage sensing part 610 may obtain the differential voltage (Vref−Vth) stored in the sensing capacitor Csa by sensing the voltage of the fourth node N4 of FIG. 2, and may obtain and output the threshold voltage Vth of each pixel from the differential voltage (Vref−Vth).

The voltage drop sensing part 620 may sense the voltage drops for at least two pixels (for example, PX[1,j] and PX[p,j] of FIG. 4) among target pixels (for example, PX[1,j] to PX[p,j] of FIG. 4) connected to a j-th data line DL[j] (j is a positive integer) and a j-th receiving line RL[j], and may calculate the voltage drop Vdrop for each of the target pixels by using the sensed voltage drops.

In one embodiment, for example, in the circuit configuration as shown in FIG. 2, a voltage (VDD−Vdrop) including the voltage drop Vdrop may be stored in the sensing capacitor Csa by the data driver 400 and the scan driver 300 to perform an operation during a voltage drop sensing period, which will be described later in greater detail with reference to FIG. 7. The voltage drop sensing part 620 may obtain the voltage (VDD−Vdrop) stored in the sensing capacitor Csa by sensing the voltage of the fourth node N4 of FIG. 2, and may sense the voltage drop Vdrop from the obtained voltage (VDD−Vdrop).

In one embodiment, for example, the voltage drop sensing part 620 may sense the voltage drops for the at least two pixels based on the voltage transmitted from the sensing capacitor Csa illustrated in FIG. 2.

The offset voltage calculator 630 may calculate an offset voltage (Vdrop_offset) that compensates the calculated voltage drop for each of the target pixels.

The offset voltage adder 640 may output the corrected threshold voltage (Vth') by adding the offset voltage (Vdrop_offset) and the sensed threshold voltage Vth with respect to the target pixels. In one embodiment, for example, the offset voltage adder 640 may be implemented with various types of adders.

The threshold voltage sensing part 610 and the voltage drop sensing part 620 may sense the voltage (or the voltage of the fourth node N4) stored in the sensing capacitor Csa based on the circuit configuration of the sensing part 600 illustrated in FIG. 2, and may sense the voltage drop or threshold voltage from the sensed voltage.

Hereinafter, an operation of each constituent element will be described in detail.

Figure 7:
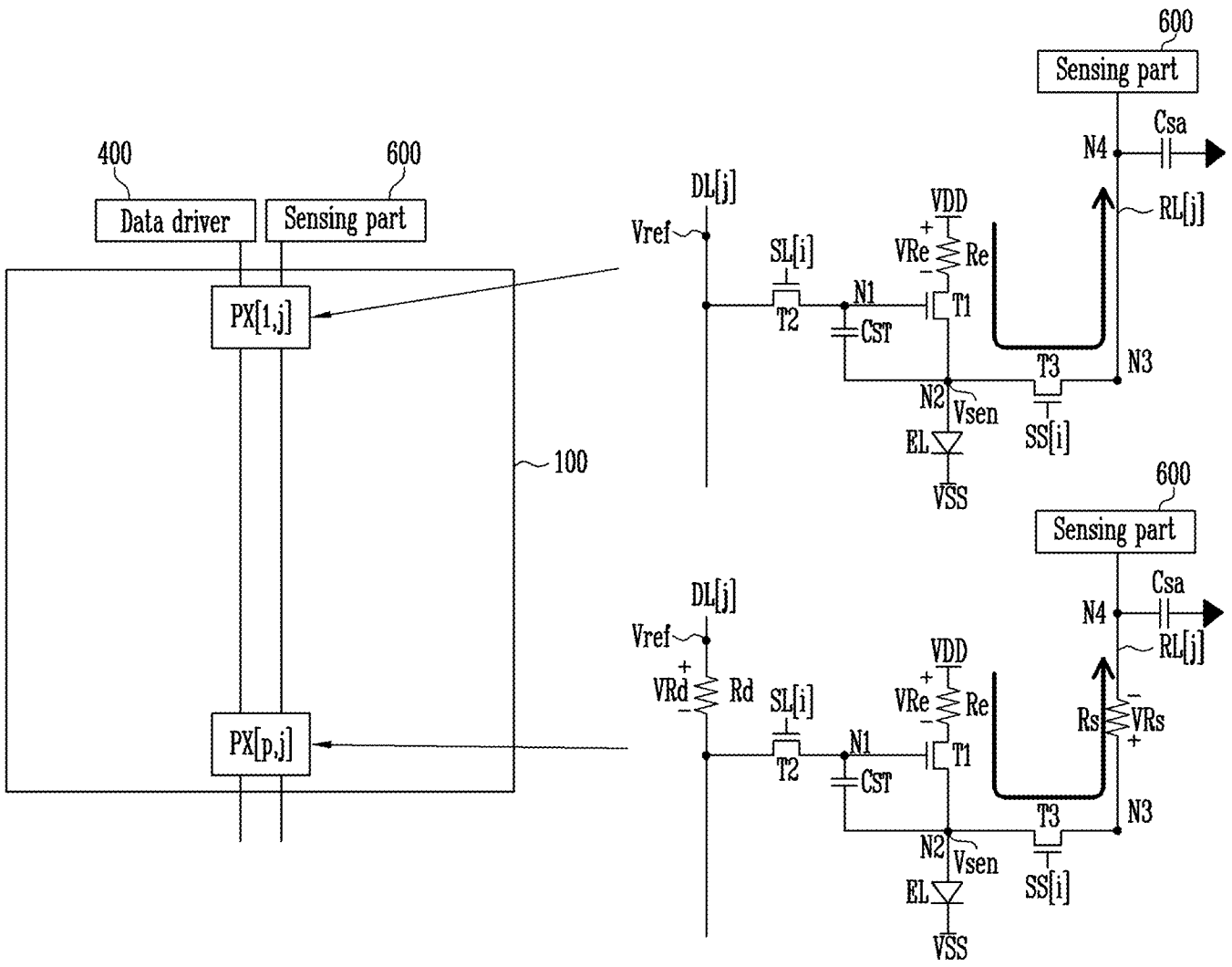
FIG. 7 illustrates a conceptual diagram showing a voltage drop of a pixel sensed by the sensing part in FIG. 6 and contents of the voltage drop.
Figure 8:
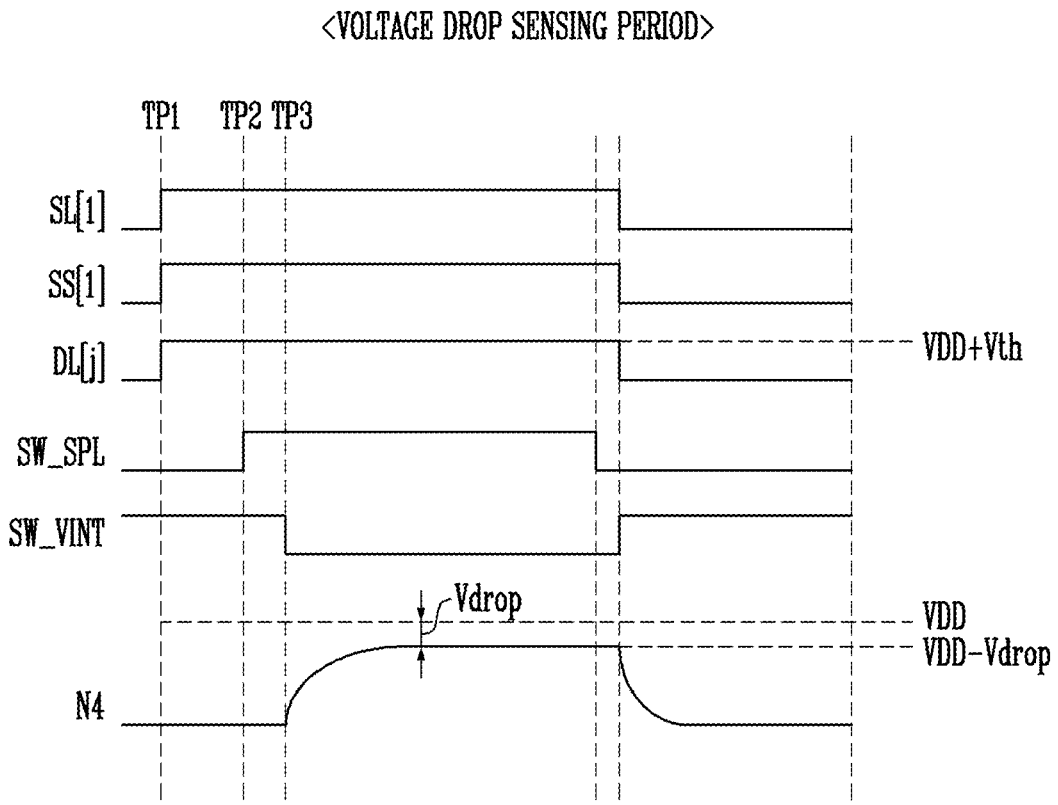
FIG. 8 illustrates a waveform diagram of an operation performed by the sensing part in FIG. 6 in a voltage drop sensing period.

FIG. 7 is a conceptual diagram showing a voltage drop of a pixel sensed by the sensing part in FIG. 6 and contents of the voltage drop. FIG. 8 illustrates a waveform diagram of an operation performed by the sensing part in FIG. 6 in a voltage drop sensing period.

Hereinafter, for convenience of description, an operation of the sensing part 600 will be described with reference to pixels connected to the j-th data line DL[j] and the j-th receiving line RL[j] (that is, pixels arranged on a same vertical line) as target pixels.

In an embodiment of the invention, a voltage corresponding to the first power source VDD may be used to sense the voltage drop caused due to the internal resistances Rd and Rs of the data line DL[j] and the receiving line RL[j] in each of the pixels.

In an embodiment, as described with reference to FIG. 4, since the first pixel PX[1,j] disposed on the first horizontal line is adjacent to the data driver 400 and the sensing part 600, the wire internal resistances Rd and Rs thereof may be minimal, while the second pixel PX[p,j] disposed on the last horizontal line may have the largest wire internal resistance Rd and Rs.

Accordingly, the voltage drop sensing part 620 may sense the voltage drops of the first pixel PX[1,j] disposed on the first horizontal line and the second pixel PX[p,j] disposed on the last horizontal line among the target pixels connected to the j-th data line DL[j] and the j-th receiving line RL[j], and may calculate the voltage drop for each of the target pixels by using the sensed voltage drops.

Hereinafter, an operation of sensing the voltage drop for the first pixel PX[1,j] will be described with reference to FIG. 7 and FIG. 8.

First, at a first time point TP1, the scan driver 300 may transmit a scan signal and a sensing signal to the scan line SL[1] and the sensing line SS[1] connected to the first pixel PX[1,j], respectively, and the data driver 400 may supply the reference voltage Vref to the data line DL[j] connected to the first pixel PX[1,j].

In this case, the voltage of the first power source VDD may be reduced by the voltage drop VRe corresponding to the internal resistance Re of the line to which the first power source VDD is applied to be applied to the first electrode of the first transistor T1.

Here, unlike the sensing period of the threshold voltage Vth in FIG. 3, the reference voltage Vref may be the voltage (VDD+Vth) obtained by adding the voltage of the first power source VDD and the threshold voltage Vth sensed for the first transistor T1 of the first pixel PX[1,j]. Therefore, since the first transistor T1 maintains a turn-on state until the first electrode and the second electrode of the first transistor T1 have a same voltage as each other by the reference voltage Vref, the voltage (VDD−VRe) applied to the first electrode of the first transistor T1 may be applied to the second node N2 as it is.

At a second time point TP2, the sensing switch SW_SPL is turned on, and at least one capacitor included in the sensing part 600 may be initialized with the initialization voltage corresponding to the initialization power source.

Since the initialization switch SW_VINT is turned off at a third time point TP3, the voltage (VDD−VRe) applied to the second node N2 at the first time point TP1 may be transmitted to the third node N3. In addition, the internal resistance Rs of the receiving line RL[j] connected between the first pixel PX[1,j] and the sensing part 600 may be minimal, the voltage transmitted to the third node N3 may be transmitted to the fourth node N4 as it is, and to the sensing capacitor Csa connected to the fourth node N4.

Therefore, the voltage sensed by the sensing part 600 through the sensing capacitor Csa may be the voltage (VDD−VRe) reduced by the voltage drop VRe corresponding to the internal resistance Re of the line to which the first power source VDD is applied from the voltage of the first power source VDD, and the voltage drop Vdrop for the first pixel PX[1,j] may be the same as the voltage drop VRe corresponding to the internal resistance Re of the line to which the first power source VDD is applied.

Similar to the operation of sensing the voltage drop for the first pixel PX[1,j], the voltage drop may also be sensed for the second pixel PX[p,j]. In the second pixel PX[p,j], the internal resistance Re of the line to which the first power source VDD is applied may be the same as that of the first pixel PX[1,j]. In one embodiment, for example, where the first power source VDD is supplied from both sides (specifically, upper and lower portions) of the display panel 100, the internal resistance Re of the lines to which the first power source VDD is applied may be regarded as the same as each other. However, the voltage drop VRs of the receiving line RL[j] may additionally occur in the second pixel PX[p,j]. Therefore, the voltage transmitted to the fourth node N4 may be the voltage (VDD−VRe−VRs) obtained by subtracting the voltage drop VRe corresponding to the internal resistance Re of the line to which the first power source VDD is applied, and the voltage drop VRs of the receiving line RL[j] from the voltage of the first power source VDD. That is, the voltage drop Vdrop for the second pixel PX[p,j] may be the voltage (VRe+VRs) obtained by adding the voltage drop VRe corresponding to the internal resistance Re of the line to which the first power source VDD is applied, and the voltage drop VRs of the receiving line RL[j].

In an embodiment, as described above, each of the voltage drops for the first pixel PX[1,j] and the second pixel PX[p,j] has the voltage drop VRe corresponding to the internal resistance Re of the line to which the first power source VDD is applied. Accordingly, the voltage drop sensing part 620 may calculate the maximum voltage drop VRs by subtracting the voltage drop VRe sensed for the first pixel PX[1,j] and the voltage drop (VRe+VRs) sensed for the second pixel PX[p,j] from each other.

As illustrated in FIG. 7, in an embodiment where the data driver 400 and the sensing part 600 are disposed at one side of the upper portion of the display panel 100, the second pixel PX[p,j] is disposed on a horizontal line farthest from the data driver 400 and the sensing part 600. Accordingly, the voltage drop VRs of the receiving line RL[j] connected to the second pixel PX[p,j] may be the maximum voltage drop among the voltage drops for the target pixels.

The voltage drop sensing part 620 may interpolate the maximum voltage drop based on the number of the horizontal lines in which the pixels are disposed to calculate the voltage drop for each of the target pixels. In one embodiment, for example, since the number of horizontal lines according to an ultra-high definition ("UHD") resolution is 2160, dividing the maximum voltage drop VRs by the number of horizontal lines may result in the voltage drop for each of the target pixels.

In an embodiment, as shown by a path shown in FIG. 7, the maximum voltage drop VRs includes only the voltage drop VRs corresponding to the internal resistance Rs of the receiving line RL[j], and does not include the voltage drop VRd according to the internal resistance Rd of the data line DL[j].

In an embodiment, where the data line DL[j] and the receiving line RL[j] are manufactured in a same wire form through a same process and the data driver 400 and the sensing part 600 are disposed on one side of the upper or lower portion of the display panel 100 together, the voltage drop VRd corresponding to the internal resistance Rd of the data line DL[j] and the voltage drop VRs corresponding to the internal resistance Rs of the receiving line RL[j] may be substantially the same as each other. Accordingly, in such an embodiment, the voltage drop sensing part 620 may calculates a value corresponding to twice the maximum voltage drop VRs previously calculated, so that the maximum voltage drop reflecting both the voltage drop VRs of the receiving line RL[j] and the voltage drop VRd of the data line DL[j] may be calculated.

In one embodiment, for example, instead of the voltage drop sensing part 620 multiplying the maximum voltage drop VRs by 2, the offset voltage calculator 630 may generate an offset voltage (Vdrp_offset) corresponding to twice the maximum voltage drop VRs.

Accordingly, an embodiment of the sensing part 600 according to the invention may sense the voltage drop (Vdrop=VRd+VRs) of the data line DL[j] and the receiving line RL[j], the threshold voltage Vth of each pixel PX[i,j] by the sensed voltage drop Vdrop may be corrected to output he corrected threshold voltage (Vth').

Figure 9:
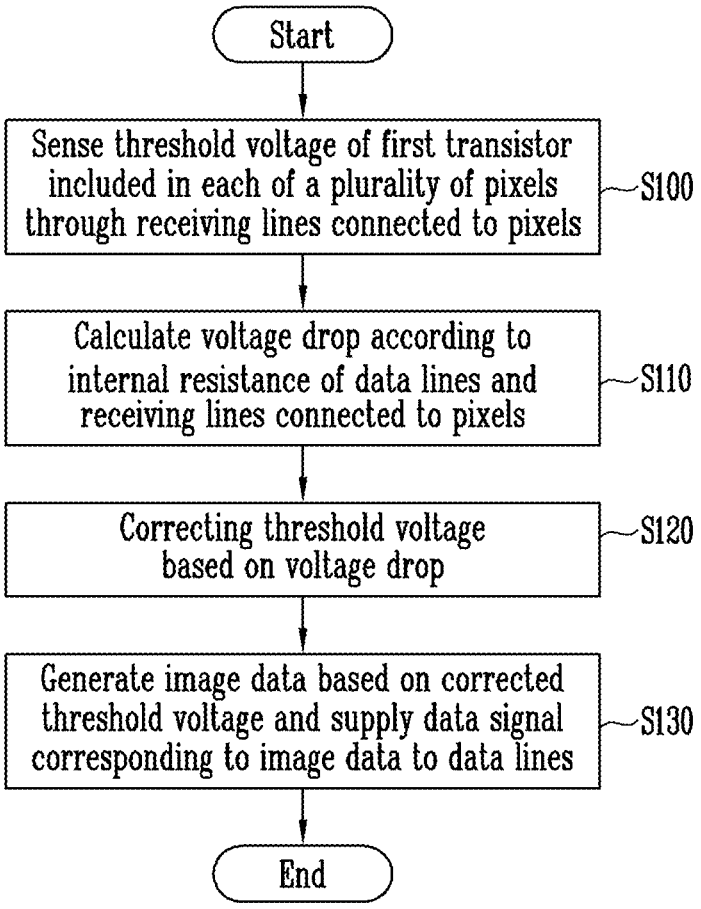
FIG. 9 illustrates a flowchart of a driving method of a display device according to an embodiment of the invention.

FIG. 9 illustrates a flowchart of a driving method of a display device according to an embodiment of the invention.

Referring to FIG. 9, an embodiment of the driving method of the display device may include: sensing a threshold voltage of a first transistor included in each of the pixels through the receiving lines connected to the pixels (S100); calculating a voltage drop based on an internal resistance of the data lines and the receiving lines connected to the pixels (S110); correcting the threshold voltage based on the calculated voltage drop (S120); and generating an image data based on the corrected threshold voltage and supplying a data signal corresponding to the image data to the data lines (S130).

The calculating (S110) of the voltage drop may include: sensing the voltage drop for at least two pixels among the target pixels connected to the j-th data line (j is a natural number of 1 or more) and the j-th receiving line; calculating the voltage drop for each of the target pixels by using the sensed voltage drop; calculating the offset voltage compensating for the voltage drop; and adding the offset voltage and the threshold voltage sensed for the target pixels.

The at least two pixels may include a first pixel disposed on the first horizontal line of the display panel and a second pixel disposed on the last horizontal line of the display panel.

The sensing of the voltage drop for the at least two pixels may include: supplying the scan signal and the sensing signal to the scan line and the sensing line connected to the first pixel, respectively, and supplying the reference voltage determined based on the threshold voltage sensed for the first pixel to the data line connected to the first pixel.

The reference voltage may be a voltage obtained by adding the voltage of the first power source and the threshold voltage sensed for the first transistor of the first pixel.

The voltage drop for the at least two pixels may include the voltage drop corresponding to the internal resistance of the line to which the first power source is applied.

The calculating of the voltage drop for each of the target pixels may include calculating the maximum voltage drop by subtracting the first voltage drop sensed for the first pixel and the second voltage drop sensed for the second pixel from each other.

The calculating of the voltage drop for each of the target pixels may include calculating the voltage drop for each of the target pixels by interpolating the maximum voltage drop based on the number of horizontal lines on which the pixels are disposed.

In such an embodiment, the display device may be the display device DD described above with reference to FIG. 1 to FIG. 9. In such an embodiment, the driving method of the display device may include the configuration and operation method of the display device DD described above with reference to FIG. 1 to FIG. 8.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel including a plurality of pixels;

a scan driver which supplies a scan signal to a plurality of scan lines connected to the pixels and supplies a sensing signal to a plurality of sensing lines connected to the pixels;

a data driver which supplies a data signal corresponding to image data to a plurality of data lines connected to the pixels;

a sensing part which senses a threshold voltage of a first transistor included in each of the pixels through a plurality of receiving lines connected to the pixels, and corrects a sensed threshold voltage based on a voltage drop corresponding to at least one of an internal resistance of the data lines and an internal resistance of the receiving lines; and a timing controller which generates the image data by changing input image data based on a corrected threshold voltage.

2. The display device of claim 1, wherein the sensing part includes:

a threshold voltage sensing part which senses the threshold voltage of the first transistor;

a voltage drop sensing part which senses the voltage drop for at least two selected pixels among target pixels connected to a j-th data line and a j-th receiving line among the pixels, and configured to calculate the voltage drop for each of the target pixels by using a sensed voltage drop, wherein j is a positive integer;

an offset voltage calculator which calculates an offset voltage compensating for the voltage drop; and an offset voltage adder which adds and outputs the threshold voltage sensed for the target pixels to the offset voltage.

3. The display device of claim 2, wherein the at least two selected pixels includes a first pixel disposed on a first horizontal line of the display panel and a second pixel disposed on a last horizontal line of the display panel.

4. The display device of claim 3, wherein the sensing part and the data driver are disposed at a same side of the display panel.

5. The display device of claim 3, wherein the scan driver supplies the scan signal and the sensing signal to a scan line and a sensing line, which are connected to the first pixel, respectively, and the data driver supplies a reference voltage determined based on the threshold voltage sensed for the first pixel to a data line connected to the first pixel.

6. The display device of claim 5, wherein the reference voltage is a voltage obtained by adding a voltage of a first power source and a threshold voltage sensed for the first transistor of the first pixel.

7. The display device of claim 6, wherein the voltage drop sensed for the at least two selected pixels includes a voltage drop corresponding to an internal resistance of a line to which the first power source is applied.

8. The display device of claim 5, wherein the voltage drop sensing part calculates a maximum voltage drop by differentiating a first voltage drop sensed for the first pixel and a second voltage drop sensed for the second pixel.

9. The display device of claim 8, wherein the voltage drop sensing part calculates the voltage drop for each of the target pixels by interpolating the maximum voltage drop based on a number of horizontal lines in which the pixels are disposed.

10. The display device of claim 2, wherein each of the target pixels includes:

the first transistor connected between a first power source and a second node, wherein the first transistor includes a gate electrode connected to a first node;

a second transistor connected between the j-th data line and the first node, wherein the second transistor includes a gate electrode connected to a corresponding one of the scan lines;

a third transistor connected between the second node and a third node connected to the j-th receiving line, wherein the third transistor includes a gate electrode connected to a corresponding one of the sensing lines;

a storage capacitor connected between the first node and the second node; and a light emitting element including a first electrode connected to the second node and a second electrode connected to a second power source.

11. The display device of claim 10, wherein the display panel further includes:

a sensing capacitor connected between a ground and a fourth node connected through the j-th receiving line to the third node, wherein the sensing capacitor stores a voltage applied to the fourth node and transmits a stored voltage to the sensing part.

12. The display device of claim 11, wherein the voltage drop sensing part senses the voltage drop for the at least two selected pixels based on a voltage transmitted from the sensing capacitor.

13. A driving method of a display device, the method comprising:

sensing a threshold voltage of a first transistor included in each of a plurality of pixels of the display device through a plurality of receiving lines connected to the pixels;

calculating a voltage drop corresponding to an internal resistance of a plurality of data lines and the receiving lines connected to the pixels;

correcting a sensed threshold voltage based on a calculated voltage drop; and generating image data based on a corrected threshold voltage and supplying a data signal corresponding to the image data to the data lines.

14. The driving method of the display device of claim 13, wherein the calculating the voltage drop includes:

sensing a voltage drop for at least two selected pixels among target pixels connected to a j-th data line and a j-th receiving line, wherein j is a positive integer;

calculating a voltage drop for each of the target pixels by using a sensed voltage drop;

calculating an offset voltage which compensates for a calculated voltage drop; and adding and outputting the offset voltage and the threshold voltage sensed for the target pixels.

15. The driving method of the display device of claim 14, wherein the at least two selected pixels include a first pixel disposed on a first horizontal line of a display panel and a second pixel disposed on a last horizontal line of the display panel.

16. The driving method of the display device of claim 15, wherein the sensing the voltage drop for the at least two selected pixels includes:

supplying a scan signal and a sensing signal to a scan line and a sensing line which are connected to the first pixel, respectively, and supplying a reference voltage determined based on a threshold voltage sensed for the first pixel to a data line connected to the first pixel.

17. The driving method of the display device of claim 16, wherein the reference voltage is a voltage obtained by adding a voltage of a first power source and a threshold voltage sensed for the first transistor of the first pixel.

18. The driving method of the display device of claim 17, wherein the voltage drop for the at least two selected pixels includes a voltage drop corresponding to an internal resistance of a line to which the first power source is applied.

19. The driving method of the display device of claim 15, wherein the calculating the voltage drop for each of the target pixels includes:

calculating a maximum voltage drop by differentiating a first voltage drop sensed for a first pixel and a second voltage drop sensed for the second pixel from each other.

20. The driving method of the display device of claim 19, wherein the calculating the voltage drop for each of the target pixels includes:

calculating a voltage drop for each of the target pixels by interpolating the maximum voltage drop based on a number of horizontal lines in which the pixels are disposed.

* * * * *